US009016175B2

(12) United States Patent
Wu

(10) Patent No.: US 9,016,175 B2
(45) Date of Patent: Apr. 28, 2015

(54) CLUTCH FOR TORQUE-EXERTING DEVICE

(75) Inventor: Jih Chun Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 332 days.

(21) Appl. No.: 13/604,603

(22) Filed: Sep. 5, 2012

(65) Prior Publication Data

US 2014/0060270 A1 Mar. 6, 2014

(51) Int. Cl.
*B25B 23/157* (2006.01)
*B25B 23/142* (2006.01)

(52) U.S. Cl.
CPC ..... *B25B 23/1427* (2013.01)

(58) Field of Classification Search
CPC ..... B25B 23/1427; B25B 23/1422; B25B 23/142; B25B 23/141; B25B 15/02; F16D 7/044
USPC ..... 81/52, 467, 473–476, 478, 480; 73/862, 73/862.08
See application file for complete search history.

(56) References Cited

U.S. PATENT DOCUMENTS

| | | | | | |
|---|---|---|---|---|---|
| 2,461,447 | A * | 2/1949 | Siesel | 464/37 |
| 2,632,485 | A * | 3/1953 | Peck | 81/474 |
| 2,885,918 | A * | 5/1959 | Allimann | 81/474 |
| 2,963,134 | A * | 12/1960 | Banner | 192/56.32 |
| 4,883,130 | A * | 11/1989 | Dixon | 173/178 |
| 5,239,875 | A * | 8/1993 | Stasiek et al. | 73/862.23 |
| 5,505,676 | A * | 4/1996 | Bookshar | 477/178 |
| 6,487,943 | B1 * | 12/2002 | Jansson et al. | 81/475 |
| 7,197,968 | B2 * | 4/2007 | Bubel | 81/475 |
| 7,383,756 | B1 * | 6/2008 | Liu | 81/467 |
| 2006/0043809 | A1 * | 3/2006 | Lau et al. | 310/91 |
| 2007/0125206 | A1 * | 6/2007 | Zhang et al. | 81/475 |
| 2007/0289420 | A1 * | 12/2007 | Gao | 81/474 |
| 2011/0092295 | A1 * | 4/2011 | Wernz et al. | 464/37 |

* cited by examiner

*Primary Examiner* — Lee D Wilson
*Assistant Examiner* — Melanie Alexander

(57) ABSTRACT

A torque-exerting device includes a clutch arranged between a handle and an axle. The handle includes a chamber defined therein by a wall. The clutch includes a movable element, a rotatable element, recesses and balls. The movable element is placed in the chamber in an axially movable manner. The rotatable element is placed in the chamber in a rotatable manner and secured to the axle. The rotatable element is in releasable engagement with the movable element. The recesses are defined in the movable element or the wall of the chamber of the handle. Each of the balls is partially placed in a respective one of the recesses and in contact with the wall of the chamber of the handle or the movable element.

15 Claims, 7 Drawing Sheets

CLUTCH FOR TORQUE-EXERTING DEVICE

BACKGROUND OF INVENTION

1. Field of Invention

The present invention relates to a torque-exerting device and, more particularly, to a clutch for a torque-exerting device.

2. Related Prior Art

There are various torque-exerting devices such as screwdrivers and wrenches. These torque-exerting devices can be classified into hand tools and automatic tools. The automatic tools can be classified into pneumatic and electric tools. Some of the torque-exerting devices include clutches to transmit predetermined values of torque.

The clutches can be classified into a ratchet-type and a ball-type. A ratchet-type of clutch includes a movable element and a rotatable element. The movable element includes ratchets for releasable engagement with ratchets of the rotatable element. In use, the movable element is placed in a handle for example so that the former is movable up and down in the latter. The rotatable element is placed in the handle so that the former is rotatable in the latter. The rotatable element is engaged with a bit. A predetermined value of torque can be transferred to the bit from the handle via the clutch. Under the predetermined value of torque, the ratchets of the movable element are engaged with the ratchets of the rotatable element for transmitting the torque. At the predetermined value of torque, the ratchets of the movable element are disengaged from the ratchets of the rotatable element. When the ratchets of the movable element are disengaged from the ratchets of the rotatable element, the movable element is moved up and down in the handle. The movable element tends to wear away the handle.

The present invention is therefore intended to obviate or at least alleviate the problems encountered in prior art.

SUMMARY OF INVENTION

It is the primary objective of the present invention to provide a torque-exerting device with a durable clutch.

To achieve the foregoing objective, the clutch is arranged between a handle and an axle of the torque-exerting device. The handle includes a chamber defined therein by a wall. The clutch includes a movable element, a rotatable element, recesses and balls. The movable element is placed in the chamber in an axially movable manner. The rotatable element is placed in the chamber in a rotatable manner and secured to the axle. The rotatable element is in releasable engagement with the movable element. The recesses are defined in the movable element or the wall of the chamber of the handle. Each of the balls is partially placed in a respective one of the recesses and in contact with the wall of the chamber of the handle or the movable element.

In another aspect, the handle includes a chamber and at least one recess. The chamber is defined by a wall. The recess is defined in the wall of the chamber of the handle. The clutch includes a movable element, a rotatable element and at least one ball. The movable element is placed in the chamber in an axially movable manner. The rotatable element is placed in the chamber in a rotatable manner and secured to the axle. The rotatable element is in releasable engagement with the movable element. The ball is partially placed in the recess and partially in contact with the movable element.

Other objectives, advantages and features of the present invention will be apparent from the following description referring to the attached drawings.

BRIEF DESCRIPTION OF DRAWINGS

The present invention will be described via detailed illustration of four embodiments referring to the drawings wherein.

DETAILED DESCRIPTION OF EMBODIMENTS

Figure 1:
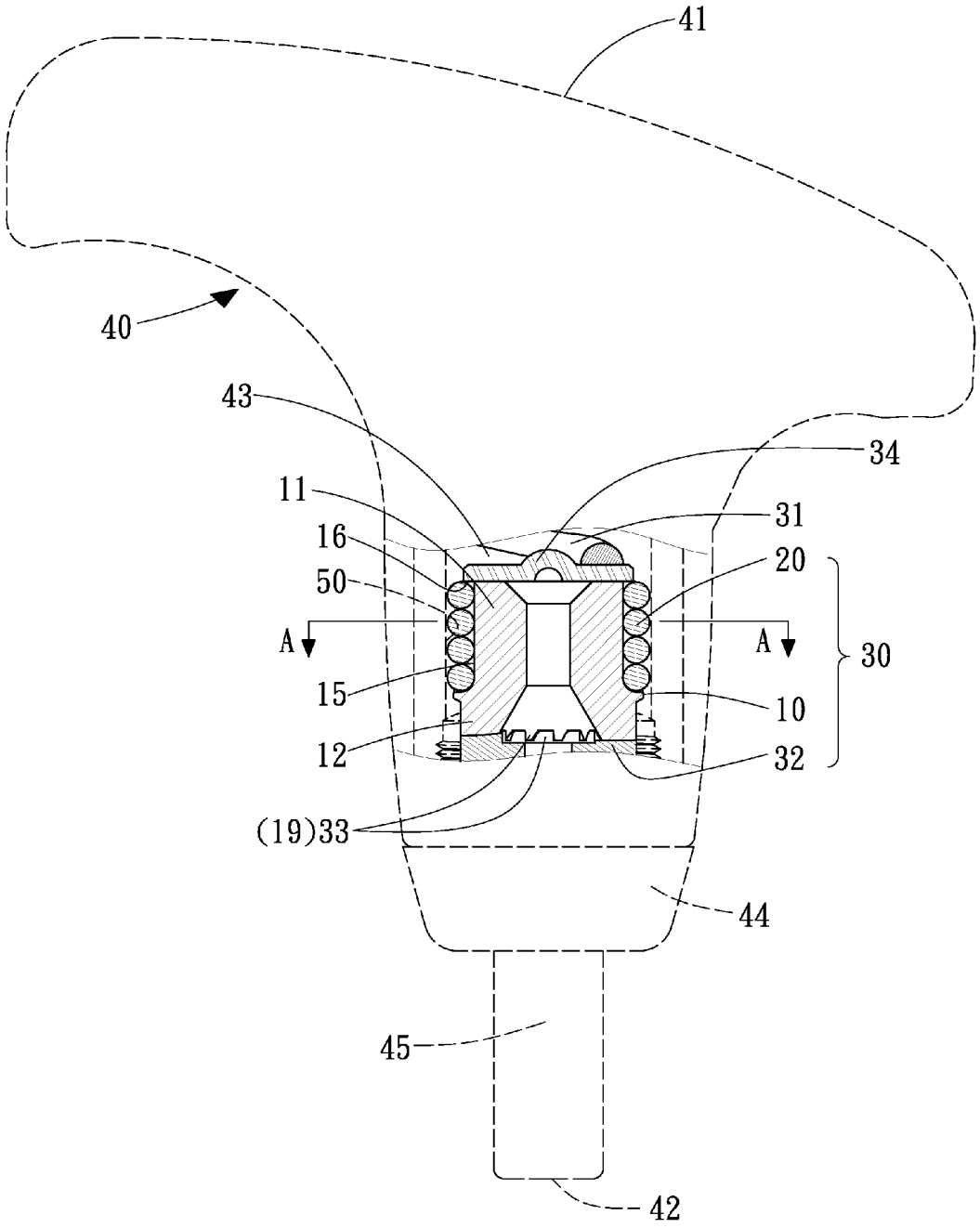
FIG. 1 is a cross-sectional view of a torque-exerting device equipped with a clutch according to the first embodiment of the present invention.
Figure 3:
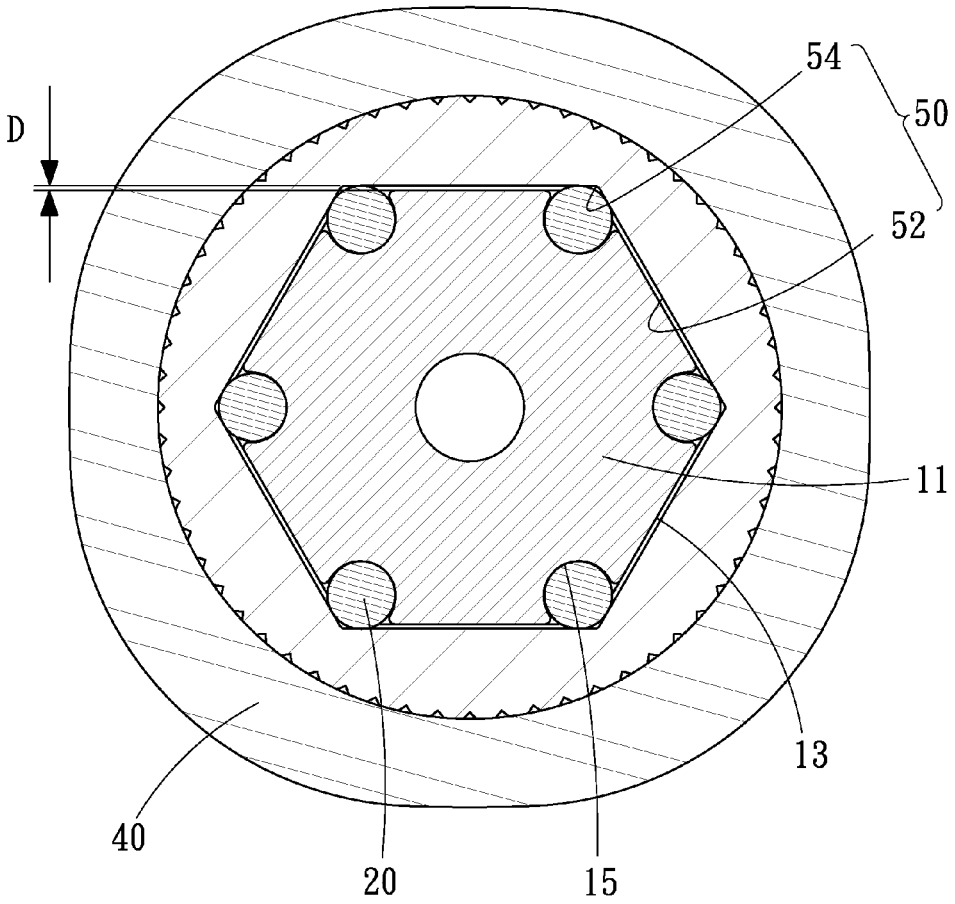
FIG. 3 is a cross-sectional view of the torque-exerting device taken along a line A-A shown in FIG. 1.

Referring to FIG. 1, a torque-exerting device 40 includes a clutch 30 arranged between a handle 41 and an axle 45 according to a first embodiment of the present invention. The torque-exerting device 40 is a screwdriver in accordance with the first embodiment. In use, the axle 45 is engaged with a bit. A predetermined value of torque can be transferred to the bit from the handle 41 via the clutch 30. Under the predetermined value of torque, the handle 41 is engaged with the axle 45 via the clutch 30 for transmitting the torque. At the predetermined value of torque, the handle 41 is disengaged from the axle 45 via the clutch 30. The handle 41 includes a chamber 43 defined therein for holding the clutch 30. Referring to FIG. 3, the chamber 43 is defined by a polygonal wall 50. The polygonal wall 50 is preferably a hexagonal wall that includes six facets 52 alternately arranged with six corners 54.

Figure 2:
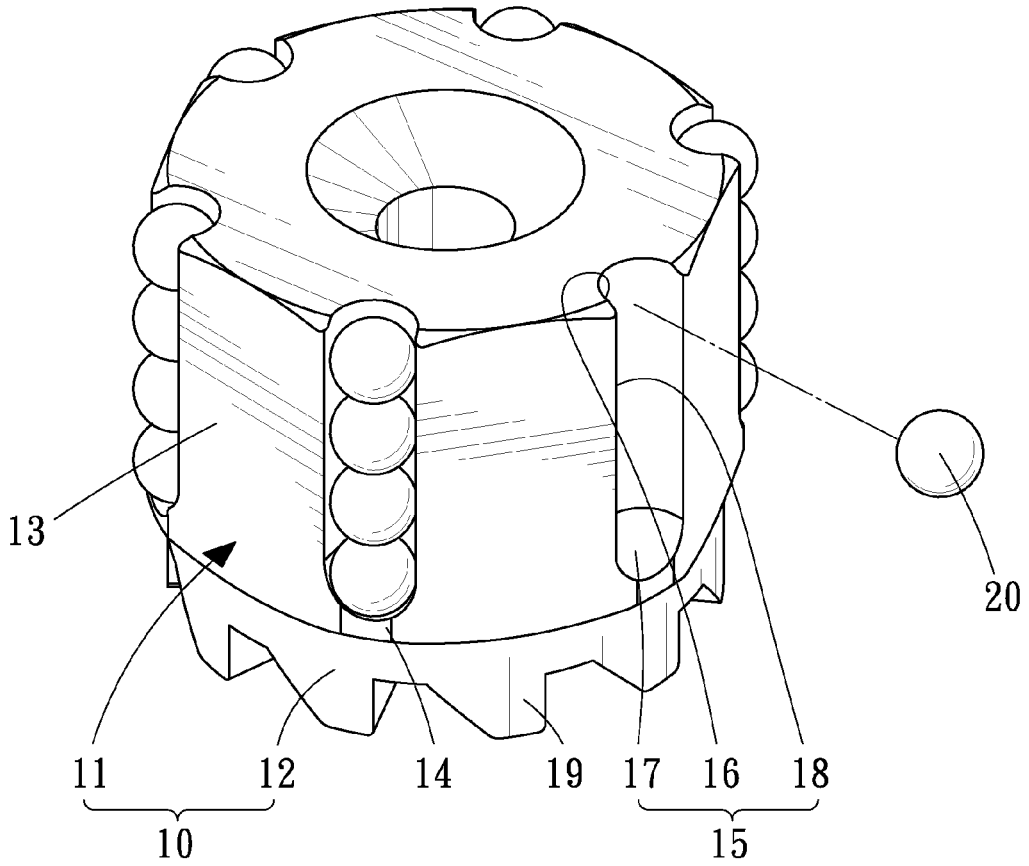
FIG. 2 is a perspective view of a movable element of the clutch shown in FIG. 1.

The clutch 30 includes a movable element 10, a rotatable element 32, a spring 31, a plurality of balls 20 and a cover 34. As best shown in FIG. 2, the movable element 10 includes a hexagonal portion 11, a circular portion 12 coaxially extending from the hexagonal portion 11, and ratchets 19 longitudinally extending from the circular portion 12. The ratchets 19 are arranged along a circle at a free end of the circular portion 12 of the movable element 10.

The hexagonal portion 11 of the movable element 10 namely includes six facets 13 alternately arranged with six corners 14. The distance between any two opposite ones of the facets 13 is longer than the diameter of the circular portion 12 of the movable element 10. The hexagonal portion 11 of the movable element 10 further includes six recesses 15 each defined in a respective one of the corners 14. Each of the recesses 15 is preferably a groove that includes an open end 16, a closed end 17, and an opening 18 extending to the open end 16 from the closed end 17.

At least one of the balls 20 is placed in each of the recesses 15. Four of the balls 20 are placed in each of the recesses 15 preferably. The diameter of the balls 20 is marginally shorter than the diameter of the recesses 15 so that the former can be placed in the latter. Each ball 20 is partially placed in the respective recess 15 and partially placed out of the respective recess 15.

The diameter of the balls 20 may be shorter than or identical to the width of the openings 18 so that the former can be moved into the recesses 15 via the latter. The diameter of the balls 20 may be longer than the width of the openings 18 so that the former cannot be moved through the latter and that the balls 20 are moved into the recesses 15 via the open ends 16.

Each ball 20 includes a portion in contact with a concave face that defines the respective recess 15 and two other portions in contact with two adjacent facets 52 of the polygonal wall 50. Hence, each facet 13 is separated from the respective facet 52 by a gap D.

The rotatable element 32 includes a plurality of ratchets 33 longitudinally extending from an upper end. The ratchets 33 are arranged along a circle at the upper end of the rotatable element 32. The ratchets 33 are used for releasable engagement with ratchets 19.

In assembly, the spring 31 and the cover 34 are placed in the chamber 43. The movable element 10 and the balls 20 are placed in the chamber 43 so that the former are movable up and down in the latter. The balls 20 are kept in the recesses 15 by the cover 34. The movable element 10 is biased by the spring 31 via the cover 34. The rotatable element 32 is placed in the chamber 43 so that the former is rotatable in the latter. An upper end of the axle 45 is connected to the rotatable element 32. A ring 44 is attached to the handle 41, thus keeping the clutch 30 in the handle 41. A lower end 42 of the axle 45 extends out of the handle 41 via the ring 44. The rotatable element 32 is engaged with a bit.

In use, a predetermined value of torque can be transferred to the bit from the handle 41 via the clutch 30. Under the predetermined value of torque, the ratchets 19 of the movable element 10 are engaged with the ratchets 33 of the rotatable element 32 for transmitting the torque. At the predetermined value of torque, the ratchets 19 are disengaged from the ratchets 33. As the ratchets 19 are disengaged from the ratchets 33, the movable element 10 is moved up and down relative to the rotatable element 32 in the handle 41. The movable element 10 is however kept from the polygonal wall 50 by the balls 20 that roll on the polygonal wall 50.

The friction between the balls 20 and the polygonal wall 50 is small. Therefore, the wear of the polygonal wall 50 is mild, and the torque-exerting device 40 is durable.

Figure 4:
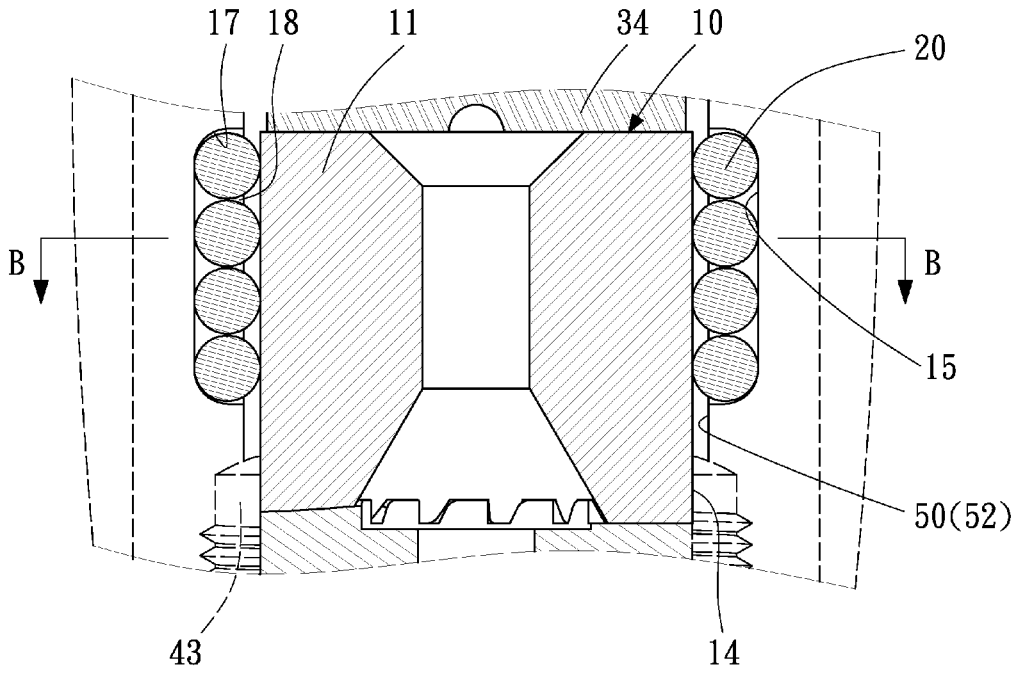
FIG. 4 is a cross-sectional view of a torque-exerting device equipped with a clutch according to the second embodiment of the present invention.
Figure 5:
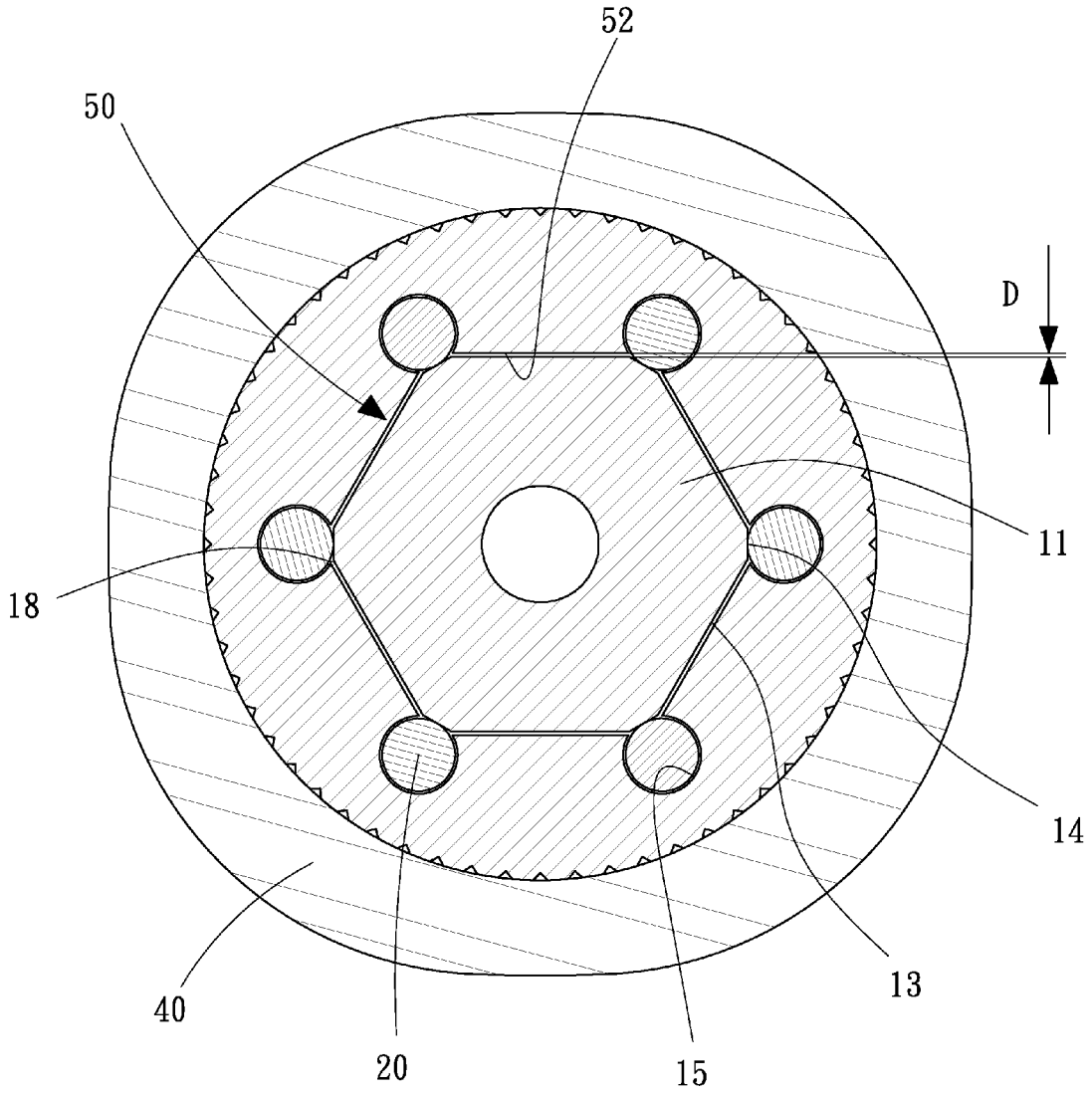
FIG. 5 is a cross-sectional view of the torque-exerting device equipped taken along a line B-B in FIG. 4.

Referring to FIGS. 4 and 5, there is shown a torque-exerting device according to a second embodiment of the present invention. The second embodiment is like the first embodiment except that each of the recesses 15 is defined in a respective corner 54 of the polygonal wall 50 of the chamber 43 of the handle 41 instead of a corner 14 of the hexagonal portion 11 of the movable element 10. Each of the recesses 15 is preferably a groove that includes two closed ends 17 and an opening 18. Each corner 14 of the polygonal portion of the movable element 10 is chamfered.

Figure 6:
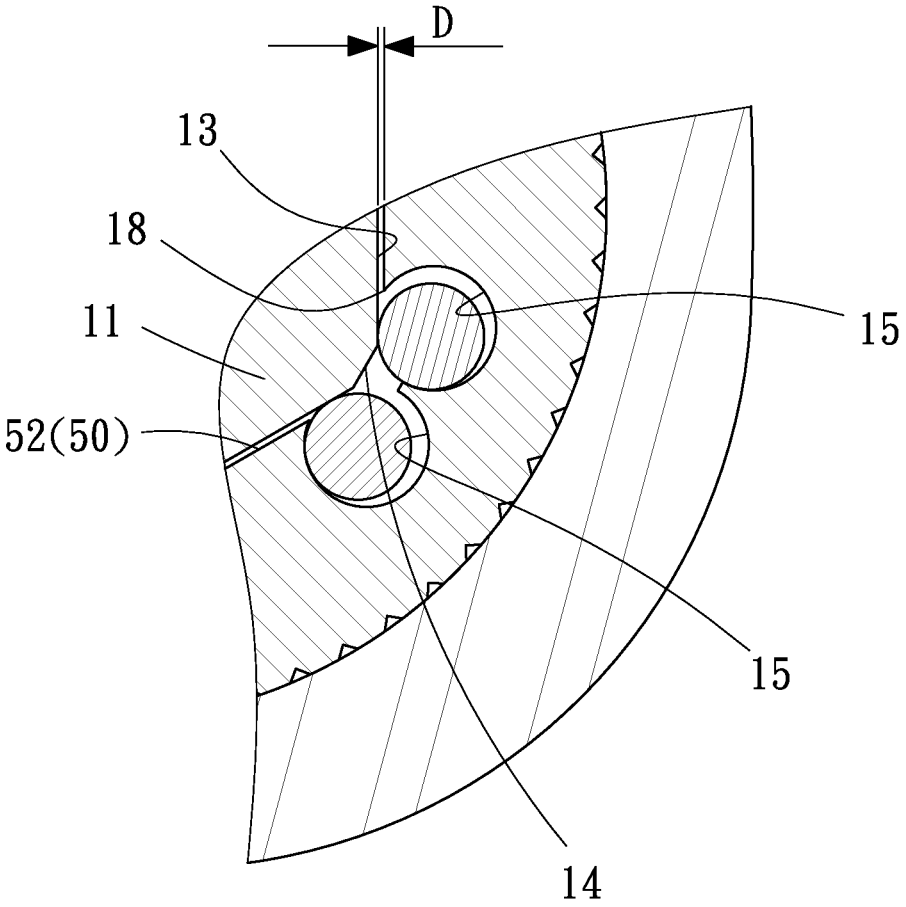
FIG. 6 is a cross-sectional view of a torque-exerting device equipped with a clutch according to the third embodiment of the present invention.

Referring to FIG. 6, there is shown a torque-exerting device according to a third embodiment of the present invention. The third embodiment is like the second embodiment except that two recesses 15, instead of one, are defined in a respective corner 54 of the polygonal wall 50 of the chamber 43 of the handle 41. In each corner 54 of the polygonal wall 50 of the chamber 43 of the handle 41, the openings 18 of the recesses 15 may or may not be overlapped.

Figure 7:
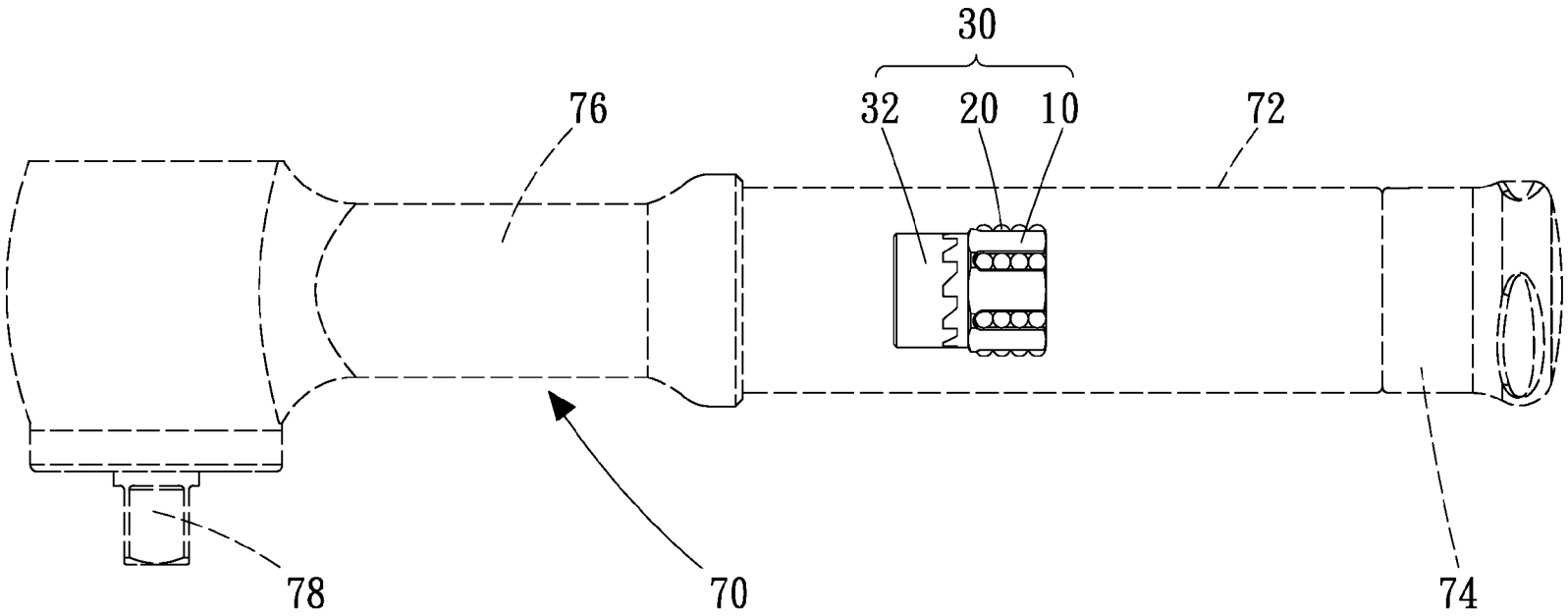
FIG. 7 is a cross-sectional view of a torque-exerting device equipped with a clutch according to the fourth embodiment of the present invention.

Referring to FIG. 7, there is shown a torque-exerting device according to a fourth embodiment of the present invention. The fourth embodiment is like the first embodiment except being a wrench 70. The wrench 70 includes a handle 72, a knob 74, a head 76 and a tongue 78. The wrench 70 further includes a transmission mechanism although the latter is not shown. In a first mode of operation, the handle 72 is rotated or pivoted about a vertical axis, i.e., about the tongue 78. Torque is transferred to the head 76 from the handle 72 and then to the tongue 78 from the head 76 via the transmission mechanism.

In a second mode of operation, the handle 72 is rotated relative to the head 76 about a horizontal axis. Torque is transferred to the transmission mechanism from the handle 72 via the clutch 30 and then to the tongue 78 from the transmission mechanism. In the second mode of operation, the value of the torque cannot exceed a limit set by operating the knob 74.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A torque-exerting device including:

a handle including a chamber defined therein by a wall;

an axle;

a clutch including:

a movable element placed in the chamber in an axially movable manner;

a rotatable element placed in the chamber in a rotatable manner and secured to the axle, wherein the rotatable element is in releasable engagement with the movable element; and recesses defined in one of the movable element and the wall of the chamber of the handle; and balls each partially placed in a respective one of the recesses and in contact with the other of the movable element and the wall of the chamber of the handle.

2. The torque-exerting device according to claim 1, wherein the recesses are defined in the movable element, wherein the balls are in contact with the wall of the chamber of the handle.

3. The torque-exerting device according to claim 2, wherein the wall of the chamber of the handle is a polygonal wall with alternate facets and corners, wherein each of the balls is in contact with two adjacent ones of the facets of the wall of the chamber of the handle.

4. The torque-exerting device according to claim 3, wherein the movable element includes a polygonal portion with alternate facets and corners, wherein each of the recesses is defined in a respective one of the corners of the polygonal portion of the movable element.

5. The torque-exerting device according to claim 1, wherein the recesses are defined in the wall of the chamber of the handle.

6. The torque-exerting device according to claim 5, wherein the movable element includes a polygonal portion with alternate facets and corners, wherein each of the balls is in contact with a respective one of the corners of the polygonal portion of the movable element.

7. The torque-exerting device according to claim 6, wherein the corners of the polygonal portion of the movable element are chamfered.

8. The torque-exerting device according to claim 6, wherein the wall is a polygonal wall with alternate facets and corners, wherein each of the recesses is defined in a respective one of the corners of the polygonal wall.

9. The torque-exerting device according to claim 6, wherein the wall is a polygonal wall with alternate facets and corners, wherein two adjacent ones of the recesses are defined in a respective one of the corners of the polygonal wall.

10. The torque-exerting device according to claim 1, wherein the clutch further includes a spring for keeping the movable element in engagement with the rotatable element.

11. The torque-exerting device according to claim 1, wherein each of the recesses includes two closed ends and an opening between the closed ends, wherein the width of the opening is identical to or shorter than the diameter of the ball.

12. The torque-exerting device according to claim 1, wherein each of the recesses includes an open end, a closed end and an opening between the open and closed ends, wherein the width of the opening is identical to or shorter than the diameter of the ball.

13. The torque-exerting device according to claim 11, wherein the clutch further includes a cover for closing the open end of the recess.

14. The torque-exerting device according to claim 13, wherein the clutch further includes a spring for biasing the movable element via the cover.

15. The torque-exerting device according to claim 1, wherein the movable element further includes ratchets longitudinally extending from an end, wherein the rotatable element includes ratchets in releasable engagement with the ratchets of the movable element.

* * * * *